US005745829A

United States Patent [19]

Gazit et al.

[11] Patent Number: 5,745,829

[45] Date of Patent: Apr. 28, 1998

[54] IMAGING APPARATUS AND INTERMEDIATE TRANSFER BLANKET THEREFOR

[75] Inventors: Alon Gazit, Nes Ziona; David Idan, Rehoyot; Hanni Inbar, Holon; Ilan Kander, Ranaana; Eli Kritchman, Tel-Aviv, all of Israel; Benzion Landa, Edmonton, Canada; Amiran Lavon, Bat Yam, Israel; Moshe Levanon, Nes Tziona, Israel; Ishaiau Lior, Nes Ziona, Israel; Jan Van Mil, Givat Nili, Israel; Yehuda Niv; Avner Schneider, both of Nes Ziona, Israel; Aron Shmaiser, Rishon Lezion, Israel; Hani Younes, Mesholash, Israel

[73] Assignee: Indigo N.V., Maastricht, Netherlands

[21] Appl. No.: 371,117

[22] Filed: Jan. 11, 1995

Related U.S. Application Data

[63] Continuation-in-part of Ser. No. 400,717, Aug. 30, 1989, Pat. No. 5,555,185, Ser. No. 115,803, Sep. 3, 1993, Pat. No. 5,572,274, Ser. No. 116,198, Sep. 3, 1993, Pat. No. 5,636,349, Ser. No. 128,149, Sep. 29, 1993, Pat. No. 5,592,269, Ser. No. 249,984, May 27, 1994, and Ser. No. 321,538, Oct. 11, 1994, abandoned, which is a continuation-in-part of Ser. No. 400,717, Ser. No. 115,803, Ser. No. 116,198, Ser. No. 128,149, and Ser. No. 249,984, which is a continuation of Ser. No. 17,410, Feb. 11, 1993, Pat. No. 5,335,054, which is a continuation of Ser. No. 777,008, Oct. 16, 1991, abandoned, which is a continuation of Ser. No. 393,631, Aug. 14, 1989, Pat. No. 5,089,856, which is a continuation-in-part of Ser. No. 306,065, Feb. 6, 1989, Pat. No. 4,984,025, said Ser. No. 400,717, is a continuation-in-part of Ser. No. 293,456, Jan. 4, 1989, abandoned, said Ser. No. 115,803, is a continuation of Ser. No. 446,877, Dec. 6, 1989, abandoned, which is a continuation-in-part of Ser. No. 293,456, said Ser. No. 116,198, is a continuation of Ser. No. 293,456.

[30] Foreign Application Priority Data

Dec. 1, 1994 [IL] Israel ..... 111846

[51] Int. Cl.[6] ..... G03G 15/01

[52] U.S. Cl. ..... 399/302; 399/303

[58] Field of Search ..... 355/271, 274, 355/275; 428/216; 399/298, 302, 303, 304, 308

[56] References Cited

U.S. PATENT DOCUMENTS

| | | |
|---|---|---|
| 415,856 | 11/1889 | Carpenter . |
| 2,501,724 | 3/1950 | Hughey . |
| 2,685,916 | 8/1954 | Martt . |

(List continued on next page.)

FOREIGN PATENT DOCUMENTS

| | | |
|---|---|---|
| 0176143 | 4/1986 | European Pat. Off. . |
| 0181723 | 5/1986 | European Pat. Off. . |
| 0247838 | 12/1987 | European Pat. Off. . |

(List continued on next page.)

OTHER PUBLICATIONS

"Web Offset Press Operating", *Grapic Arts Technology Foundation*, David B. Crouse et al., p. 32.

*IBM Technical Disclosure Bulletin*, vol. 21, No. 7, Dec. 1978.

*Primary Examiner*—William J. Royer

*Attorney, Agent, or Firm*—Greenblum & Bernstein, P.L.C.

[57] ABSTRACT

Imaging apparatus including an imaging surface having a toner image formed thereon and an intermediate transfer member, which receives the toner image from the imaging surface and from which it is subsequently transferred. The intermediate transfer member includes a drum having mounting recesses formed therein and an intermediate transfer blanket mounted on the drum. The blanket has a layered transfer portion having a transfer surface on one face thereof which receives the toner image and optionally an adhesive layer on the opposite face thereof and a mounting fixture, attached to one edge of the layered transfer portion and adapted to mate with the mounting recesses in the drum, whereby the transfer blanket is fixedly and removably mounted on the drum.

74 Claims, 6 Drawing Sheets

U.S. PATENT DOCUMENTS 3,245,511 4/1966 Macklin .
3,318,212 5/1967 Rubin .
3,394,245 7/1968 Waldrop .
3,405,683 10/1968 Jons et al. .
3,591,276 7/1971 Byrne .
3,624,353 11/1971 Bjorkland .
3,657,103 4/1972 Fisher et al. .
3,669,706 6/1972 Sanders et al. .
3,671,118 6/1972 Fantuzzo et al. .
3,684,364 8/1972 Schmidlin .
3,697,171 10/1972 Sullivan .
3,702,482 11/1972 Dolcimascolo et al. .
3,741,643 6/1973 Smith et al. .
3,746,448 7/1973 Kitch .
3,767,300 10/1973 Brown et al. .
3,795,033 3/1974 Donnelly .
3,806,355 4/1974 Kaufman .
3,809,854 5/1974 Sanders .
3,813,516 5/1974 Kudsi et al. .
3,816,929 6/1974 Kiffe et al. .
3,832,055 8/1974 Hamaker .
3,838,919 10/1974 Takahashi .
3,839,032 10/1974 Smith et al. .
3,839,919 10/1974 Mollen et al. .
3,847,478 11/1974 Young .
3,851,964 12/1974 Smith et al. .
3,862,848 1/1975 Marley .
3,863,603 2/1975 Buckley et al. .
3,893,761 7/1975 Buchan et al. ..... 355/275
3,900,003 8/1975 Sato et al. .
3,937,919 2/1976 Clerk et al. .
3,948,215 4/1976 Namiki .
3,955,533 5/1976 Smith et al. .
3,957,016 5/1976 Yamada et al. .
3,959,574 5/1976 Seanor et al. .
3,965,861 6/1976 Fukushima et al. .
3,983,287 9/1976 Goossen et al. .
3,993,825 11/1976 Buchan et al. ..... 428/216
4,000,242 12/1976 Hartbauer .
4,001,544 1/1977 Heinzer et al. .
4,015,027 3/1977 Buchan et al. ..... 427/22
4,039,257 8/1977 Connolly .
4,073,266 2/1978 Arneth et al. .
4,144,808 3/1979 Iwasa et al. .
4,145,599 3/1979 Sakurai et al. .
4,163,892 8/1979 Komatso et al. .
4,219,327 8/1980 Idstein .
4,233,385 11/1980 Hinz et al. .
4,272,872 6/1981 Hess et al. .
4,286,039 8/1981 Landa et al. .
4,325,627 4/1982 Swindler et al. .
4,341,455 7/1982 Fedder .
4,342,823 8/1982 Grant et al. .
4,348,098 9/1982 Koizumi .
4,395,109 7/1983 Nakajima et al. .
4,400,079 8/1983 Landa .
4,411,976 10/1983 Landa et al. .
4,420,680 12/1983 Itoh .
4,430,412 2/1984 Miwa et al. .
4,439,035 3/1984 Landa .
4,453,820 6/1984 Suzuki .
4,455,079 6/1984 Miwa et al. .
4,455,523 6/1984 Koenck .
4,460,667 7/1984 Landa .
4,482,242 11/1984 Moraw et al. .
4,504,138 3/1985 Kuehnle et al. .
4,512,649 4/1985 Dermiggio .
4,514,486 4/1985 Shirose et al. .
4,515,460 5/1985 Knechtel .
4,518,976 5/1985 Tarumi et al. .
4,531,824 7/1985 Landa .
4,531,825 7/1985 Miwa et al. .
4,531,827 7/1985 Tarumi et al. .
4,533,231 8/1985 Shigenobu .
4,538,899 9/1985 Landa et al. .
4,542,978 9/1985 Tarumi et al. .
4,553,081 11/1985 Koenck .
4,557,583 12/1985 Percic et al. .
4,567,349 1/1986 Henry et al. .
4,568,275 2/1986 Sakurai .
4,571,059 2/1986 Huss .
4,585,319 4/1986 Okamoto et al.. .
4,588,279 5/1986 Fukuchi et al. .
4,588,319 5/1986 Niemeyer .
4,607,940 8/1986 Quang .
4,628,183 12/1986 Satomura .
4,645,327 2/1987 Kimura et al. .
4,652,115 3/1987 Palm et al. ..... 355/275
4,653,897 3/1987 Fromm .
4,671,643 6/1987 Shigemura et al. .
4,684,238 8/1987 Till et al. .
4,690,539 9/1987 Radulski et al. .
4,708,460 11/1987 Langdon .
4,709,202 11/1987 Koenck et al. .
4,724,303 2/1988 Martin et al. .
4,743,939 5/1988 Dulmage et al. .
4,754,294 6/1988 Kato .
4,755,849 7/1988 Tarumi et al. .
4,763,158 8/1988 Schlueter, Jr. .
4,788,572 11/1988 Slayton et al. .
4,791,275 12/1988 Lee et al. .
4,794,651 12/1988 Landa et al. .
4,796,048 1/1989 Bean .
4,814,819 3/1989 Torino et al. .
4,833,058 5/1989 Hirano et al. .
4,842,972 6/1989 Tavernier et al. .
4,864,367 9/1989 Nakahara et al. .
4,873,926 10/1989 Simeth .
4,882,593 11/1989 Touma et al. .
4,891,668 1/1990 Zweedijk .
4,910,558 3/1990 Giezeman et al. .
4,912,514 3/1990 Mizutani .
4,969,012 11/1990 Suzuki et al. .
4,974,027 11/1990 Landa et al. .
4,984,025 1/1991 Landa et al. .
4,985,732 1/1991 Landa et al. .
4,999,677 3/1991 Landa et al. .
5,001,030 3/1991 Valk .
5,001,034 3/1991 Omote et al. .
5,028,964 7/1991 Landa et al. .
5,038,178 8/1991 Hosoya et al. .
5,047,808 9/1991 Landa et al. .
5,089,856 2/1992 Landa .
5,094,164 3/1992 Kowalczyk et al. .
5,108,865 4/1992 Zwaldo et al. .
5,108,867 4/1992 Wing, Jr. et al. .
5,117,263 5/1992 Adam et al. .
5,132,742 7/1992 Bujese .
5,148,222 9/1992 Lior et al. .
5,166,734 11/1992 Pinhas et al. .
5,231,454 7/1993 Landa .
5,233,396 8/1993 Simms et al. ..... 355/275
5,255,058 10/1993 Pinhas et al. .
5,273,855 12/1993 Omote et al. .
5,276,492 1/1994 Landa et al. .
5,280,326 1/1994 Pinhas et al. .
5,289,238 2/1994 Lior et al. .
5,335,054 8/1994 Landa et al. .

FOREIGN PATENT DOCUMENTS 0318078 5/1989 European Pat. Off. .
0364855 4/1990 European Pat. Off. .

| | | |
|---|---|---|
| A-0593781 | 4/1994 | European Pat. Off. . |
| 2250778 | 5/1973 | Germany . |
| 3816929 | 12/1988 | Germany . |
| 58-2863 | 9/1980 | Japan . |
| 58-123583 | 9/1981 | Japan . |
| 56-164368 | 12/1981 | Japan . |
| 57-2048 | 1/1982 | Japan . |
| 58-44472 | 3/1983 | Japan . |
| 61-17582 | 6/1986 | Japan . |
| 62-81681 | 4/1987 | Japan . |
| 62-134671 | 6/1987 | Japan . |
| 62-134673 | 6/1987 | Japan . |
| 8301978 | 6/1983 | Netherlands . |
| 1359730 | 7/1974 | United Kingdom . |
| 1409755 | 10/1975 | United Kingdom . |
| 1445143 | 8/1976 | United Kingdom . |
| 2169416 | 7/1986 | United Kingdom . |
| 2176904 | 1/1987 | United Kingdom . |
| A-2232930 | 1/1991 | United Kingdom . |
| 90/04216 | 4/1990 | WIPO . |
| 90/08984 | 8/1990 | WIPO . |
| 90/14619 | 11/1990 | WIPO . |
| WO-A-9014619 | 11/1990 | WIPO . |
| 91/03006 | 3/1991 | WIPO . |
| 91/03007 | 3/1991 | WIPO . |
| 92/10793 | 6/1992 | WIPO . |
| 92/13299 | 8/1992 | WIPO . |
| 94/02887 | 2/1994 | WIPO . |

IMAGING APPARATUS AND INTERMEDIATE TRANSFER BLANKET THEREFOR

RELATED APPLICATIONS

This application is a continuation-in-part of U.S. Ser. No. 08/249,984, IMAGE TRANSFER APPARATUS INCORPORATING AN INTEGRAL HEATER, filed May 27, 1994, which is pending, which is a continuation of U.S. Ser. No. 08/017,410, IMAGE TRANSFER APPARATUS INCLUDING INTERMEDIATE TRANSFER BLANKET, filed Feb. 11, 1993, now U.S. Pat. No. 5,335,054 which is a continuation of U.S. Ser. No. 07/777,008, IMAGE TRANSFER APPARATUS INCORPORATING AN INTERNAL HEATER, filed Oct. 16, 1991, now abandoned, which is a continuation of U.S. Ser. No. 07/393,631, IMAGE TRANSFER APPARATUS INCORPORATING AN INTERNAL HEATER, filed Aug. 14, 1989, now U.S. Pat. No. 5,089,856 which is a continuation-in-part of U.S. Ser. No. 07/306,065, IMAGING SYSTEM WITH INTERMEDIATE TRANSFER MEMBER, filed Feb. 6, 1989, now U.S. Pat. No. 4,984,025.

This application is also a continuation-in-part of U.S. Ser. No. 08/128,149, IMAGING SYSTEM HAVING AN INTERMEDIATE TRANSFER MEMBER filed Sep. 29, 1993 which is now U.S. Pat. No. 5,592,269.

This application is also a continuation-in-part of U.S. Ser. No. 08/116,198, METHOD AND APPARATUS FOR IMAGING USING AN INTERMEDIATE TRANSFER MEMBER, filed Sep. 3, 1993 which is now U.S. Pat. No. 5,636,349, which is a continuation of U.S. Ser. No. 07/293,456, METHOD AND APPARATUS FOR IMAGING USING AN INTERMEDIATE TRANSFER MEMBER, filed Jan. 4, 1989 now abandoned.

This application is also a continuation-in-part of U.S. Ser. No. 07/400,717, METHOD AND APPARATUS FOR IMAGING USING AN INTERMEDIATE TRANSFER MEMBER, filed Aug. 30, 1989 which is now U.S. Pat. No. 5,555,185, which is a continuation-in-part of U.S. Ser. No. 07/293,456, METHOD AND APPARATUS FOR IMAGING USING AN INTERMEDIATE TRANSFER MEMBER, filed Jan. 4, 1989 now abandoned.

This application is also a continuation-in-part of U.S. Ser. No. 08/115,803, LIQUID DEVELOPER IMAGING SYSTEM HAVING A HEATED INTERMEDIATE TRANSFER MEMBER, filed Sep. 3, 1993 which is now U.S. Pat. No. 5,572,274, which is a continuation of U.S. Ser. No. 07/446,877, IMAGING SYSTEM WITH AN INTERMEDIATE TRANSFER MEMBER, filed Dec. 6, 1989, now abandoned, which is a continuation-in-part of U.S. Ser. No. 07/293,456, METHOD AND APPARATUS FOR IMAGING USING AN INTERMEDIATE TRANSFER MEMBER, filed Jan. 4, 1989, now abandoned.

This application is a continuation-in-part of U.S. Ser. No. 08/321,538, IMAGING APPARATUS AND INTERMEDIATE TRANSFER BLANKET THEREFOR, filed Oct. 11, 1994, now abandoned.

U.S. Ser. No. 08/321,538 is a continuation-in-part of U.S. Ser. No. 08/249,984, IMAGE TRANSFER APPARATUS INCORPORATING AN INTEGRAL HEATER, filed May 27, 1994, which is pending, which is a continuation of U.S. Ser. No. 08/017,410, IMAGE TRANSFER APPARATUS INCLUDING INTERMEDIATE TRANSFER BLANKET, filed Feb. 11, 1993, now U.S. Pat. No. 5,335,054 which is a continuation of U.S. Ser. No. 07/777,008, IMAGE TRANSFER APPARATUS INCORPORATING AN INTERNAL HEATER, filed Oct. 16, 1991, now abandoned, which is a continuation of U.S. Ser. No. 07/393,631, IMAGE TRANSFER APPARATUS INCORPORATING AN INTERNAL HEATER, filed Aug. 14, 1989, now U.S. Pat. No. 5,089,856 which is a continuation-in-part of U.S. Ser. No. 07/306,065, IMAGING SYSTEM WITH INTERMEDIATE TRANSFER MEMBER, filed Feb. 6, 1989, now U.S. Pat. No. 4,984,025.

U.S. Ser. No. 08/321,538 is a continuation-in-part of U.S. Ser. No. 08/128,149, IMAGING SYSTEM HAVING AN INTERMEDIATE TRANSFER MEMBER, filed Sep. 29, 1993 which is now U.S. Pat. No. 5,592,269.

U.S. Ser. No. 08/321,538 is a continuation-in-part of U.S. Ser. No. 08/116,198, METHOD AND APPARATUS FOR IMAGING USING AN INTERMEDIATE TRANSFER MEMBER, filed Sep. 3, 1993 which is now U.S. Pat. No. 5,636,349, which is a continuation of U.S. Ser. No. 07/293,456, METHOD AND APPARATUS FOR IMAGING USING AN INTERMEDIATE TRANSFER MEMBER, filed Jan. 4, 1989 now abandoned.

U.S. Ser. No. 08/321,538 is a continuation-in-part of U.S. Ser. No. 07/400,717, METHOD AND APPARATUS FOR IMAGING USING AN INTERMEDIATE TRANSFER MEMBER, filed Aug. 30, 1989 which is now U.S. Pat. No. 5,555,185, which is a continuation-in-part of U.S. Ser. No. 07/293,456, METHOD AND APPARATUS FOR IMAGING USING AN INTERMEDIATE TRANSFER MEMBER, filed Jan. 4, 1989 now abandoned.

U.S. Ser. No. 08/321,538 is a continuation-in-part of U.S. Ser. No. 08/115,803, LIQUID DEVELOPER IMAGING SYSTEM HAVING A HEATED INTERMEDIATE TRANSFER MEMBER, filed Sep. 3, 1993 which is now U.S. Pat. No. 5,572,274, which is a continuation of U.S. Ser. No. 07/446,877, IMAGING SYSTEM WITH AN INTERMEDIATE TRANSFER MEMBER, filed Dec. 6, 1989, now abandoned, which is a continuation-in-part of U.S. Ser. No. 07/293,456, METHOD AND APPARATUS FOR IMAGING USING AN INTERMEDIATE TRANSFER MEMBER, filed Jan. 4, 1989, now abandoned.

FIELD OF THE INVENTION

The present invention relates to image forming and image transfer apparatus especially for use in electrostatic imaging using an intermediate transfer blanket.

BACKGROUND OF THE INVENTION

The use of an intermediate transfer member in electrostatic imaging is well known.

Various types of intermediate transfer members are known and are described, for example in U.S. Pat. Nos. 3,862,848, 4,684,238, 4,690,539 and 4,531,825 and in the RELATED APPLICATIONS listed above, the specifications of all of which are incorporated herein by reference.

Belt-type intermediate transfer members for use in electrophotography are known in the art and are described, inter alia, in U.S. Pat. Nos. 3,893,761, 4,684,238 and 4,690,539, the specifications of which are incorporated herein by reference.

The use of intermediate transfer members and members including transfer blankets for offset ink printing is also well known. Such blankets have characteristics which are suitable for ink transfer but are generally not usable, per se, for liquid toner imaging.

SUMMARY OF THE INVENTION

The present invention seeks to provide, in one aspect thereof, improved image transfer apparatus using an improved intermediate transfer member.

The present invention further seeks to provide, in a second aspect thereof, an improved image transfer member for use in imaging apparatus, especially in image forming apparatus using electrostatically charged toner.

The present invention further seeks to provide, in a third aspect thereof, an improved image transfer blanket for use as part of the image transfer member in imaging apparatus, especially in image forming apparatus using electrostatically charged toner.

There is thus provided in accordance with a preferred embodiment of the invention, imaging apparatus comprising:

an imaging surface having an image, preferably a toner image formed thereon; and an intermediate transfer member, which receives the toner image from the imaging surface and from which it is subsequently transferred, comprising:

a drum having mounting recesses formed therein; and an intermediate transfer blanket mounted on the drum, the blanket comprising:

a layered transfer portion having a transfer surface on one face thereof which receives the toner image and preferably an adhesive layer on an opposite surface thereof; and a mounting fixture, attached to only one edge of the layered transfer portion and adapted to mate with the mounting recesses in the drum, whereby the transfer blanket is removably mounted on the drum.

In a preferred embodiment of the invention at least a portion of a surface of the layered transfer portion opposite to the transfer surface is bonded to the drum.

Preferably, the layered transfer portion comprises an electrically conductive layer underlying the transfer surface; and the mounting fixture comprises an electrically conductive element, attached to one edge of the transfer portion, which is electrically connected to the electrically conductive layer.

In a preferred embodiment of the invention, the electrically conductive element, which preferably comprises at least one "L" shaped finger-like extension extending therefrom, that contacts the drum, wherein the drum is electrified to a voltage which is operative to transfer the toner image from the imaging surface to the transfer surface. Preferably, said at least one "L" shaped extension has a first portion extending in a direction perpendicular to the layered transfer portion and a second portion attached and substantially perpendicular to the first portion and extending substantially parallel to and away from the layered transfer portion.

Preferably, the mounting recesses further comprise recesses therein which receive said second portion.

There is further provided in accordance with a preferred embodiment of the invention, a substantially rectangular intermediate transfer blanket comprising:

a layered transfer portion having a transfer surface on one face thereof; and a mounting fixture, adapted for mounting the blanket on a drum, attached to only one edge of the layered transfer portion.

Preferably, the layered transfer portion comprises an electrically conductive layer underlying the transfer surface; and the mounting fixture comprises an electrically conductive element, attached to one edge of the transfer portion, which is electrically connected to the electrically conductive layer.

Preferably, the electrically conductive element comprises at least one "L" shaped finger-like extension extending therefrom, which extension preferably has a first portion extending in a direction perpendicular to the layered transfer portion and a second portion attached and substantially perpendicular to the first portion and extending substantially parallel to and away from the layered transfer portion.

In a preferred embodiment of the invention the layered transfer portion comprises a conformal layer formed of a material having a Shore A hardness of less than 65, preferably less than about 50 and more than about 30.

Preferably, the transfer surface is a release layer for toner.

There is further provided in accordance with a preferred embodiment of the invention, a substantially rectangular intermediate transfer blanket comprising:

a layered transfer portion having a transfer surface on one face and including a conductive layer underlying the transfer surface; and a conductive element, attached to one edge of the transfer portion, which is electrically connected to the conducting layer.

There is further provided in accordance with a preferred embodiment of the invention, a layered intermediate transfer member and blanket comprising:

a transfer surface on one face; and a conforming layer having a shore A hardness of less than about 65, preferably less than about 50 and preferably more than about 30.

There is further provided in accordance with a preferred embodiment of the invention, a layered intermediate transfer blanket comprising:

a transfer surface on one face of the blanket; and an adhesive layer on the opposite face of the blanket which is stable at a temperature of at least 80° C., preferably above 100° C., more preferably above 120° C., most preferably above 150° C.

There is further provided in a preferred embodiment of the invention, a layered intermediate transfer blanket comprising:

an transfer surface on one face of the blanket; and a soft layer on the opposite face of the blanket which has a Shore A hardness of less than 90, more preferably less than 45, most preferably less than 25.

In a preferred embodiment of the invention the soft layer comprises an acrylic polymer.

In a preferred embodiment of the invention the layered transfer portion comprises an adhesive layer on a side thereof opposite to the transfer surface.

There is further provided in accordance with a preferred embodiment of the invention, imaging apparatus for performing an imaging process, comprising:

an imaging surface having a liquid toner image comprising toner particles and carrier liquid formed thereon; and an intermediate transfer member, which receives the toner image from the imaging surface and from which it is subsequently transferred, comprising:

a layered transfer portion having a transfer surface on one face thereof which receives the toner image;

a resilient layer underlying the transfer surface which comprises a material which is at least partly leachable by the carrier liquid; and a barrier layer, preferably comprising at least partially hydrolyzed polyvinyl alcohol, that is substantially impervious to the carrier liquid and is situated intermediate the resilient layer and the transfer surface.

There is further provided, in a preferred embodiment of the invention a layered intermediate transfer member comprising:

a transfer surface;

a resilient layer underlying the transfer surface which comprises a material which is at least partly leachable by a liquid hydrocarbon; and a barrier layer, preferably comprising at least partially hydrolyzed polyvinyl alcohol, that is substantially impervious to the liquid hydrocarbon and is situated intermediate the resilient layer and the transfer surface.

There is further provided, in accordance with a preferred embodiment of the invention, a layered intermediate transfer member for receiving liquid toner images comprising toner particles and carrier liquid comprising:

a transfer surface;

a resilient layer underlying the transfer surface which comprises a material which is at least partly leachable in the carrier liquid; and a barrier layer, preferably comprising at least partially hydrolyzed polyvinyl alcohol, that is substantially impervious to the carrier liquid and is situated intermediate the resilient layer and the transfer surface.

There is further provided, in accordance with a preferred embodiment of the invention, imaging apparatus for performing an imaging process, comprising:

an imaging surface having a liquid toner image comprising toner particles and carrier liquid formed thereon; and an intermediate transfer member, which receives the toner image from the imaging surface and from which it is subsequently transferred, comprising:

a layered transfer portion having a transfer surface on one face thereof which receives the toner image;

a resilient layer underlying the transfer surface which comprises a material which interferes with the operation of the imaging process;

a barrier layer, preferably comprising at least partially hydrolyzed polyvinyl alcohol, that is substantially impervious to the interfering material comprised in the resilient layer and is situated intermediate the resilient layer and the transfer surface.

In a preferred embodiment of the invention, the material is a gas and the barrier layer is a barrier layer for gasses.

There is further provided, in accordance with a preferred embodiment of the invention, a layered intermediate transfer member, comprising:

a transfer surface;

a resilient layer underlying the transfer surface; and a barrier layer, preferably comprising at least partially hydrolyzed polyvinyl alcohol, that is substantially impervious to liquid hydrocarbons and is situated intermediate the resilient layer and the transfer surface.

There is further provided, in accordance with a preferred embodiment of the invention, a layered intermediate transfer member, comprising:

a transfer surface;

a resilient layer underlying the transfer surface which releases gases; and a barrier layer, preferably comprising at least partially hydrolyzed polyvinyl alcohol, that is substantially impervious to the gasses and is situated intermediate the resilient layer and the transfer surface.

There is further provided, in accordance with a preferred embodiment of the invention, a layered intermediate transfer member for receiving liquid toner images comprising toner particles and carrier liquid comprising:

a transfer surface;

a resilient layer underlying the transfer surface comprising a material which is at least partly leachable in the carrier liquid; and a barrier layer, preferably comprising at least partially hydrolyzed polyvinyl alcohol, that is substantially impervious to the carrier liquid and is situated intermediate the resilient layer and the transfer surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
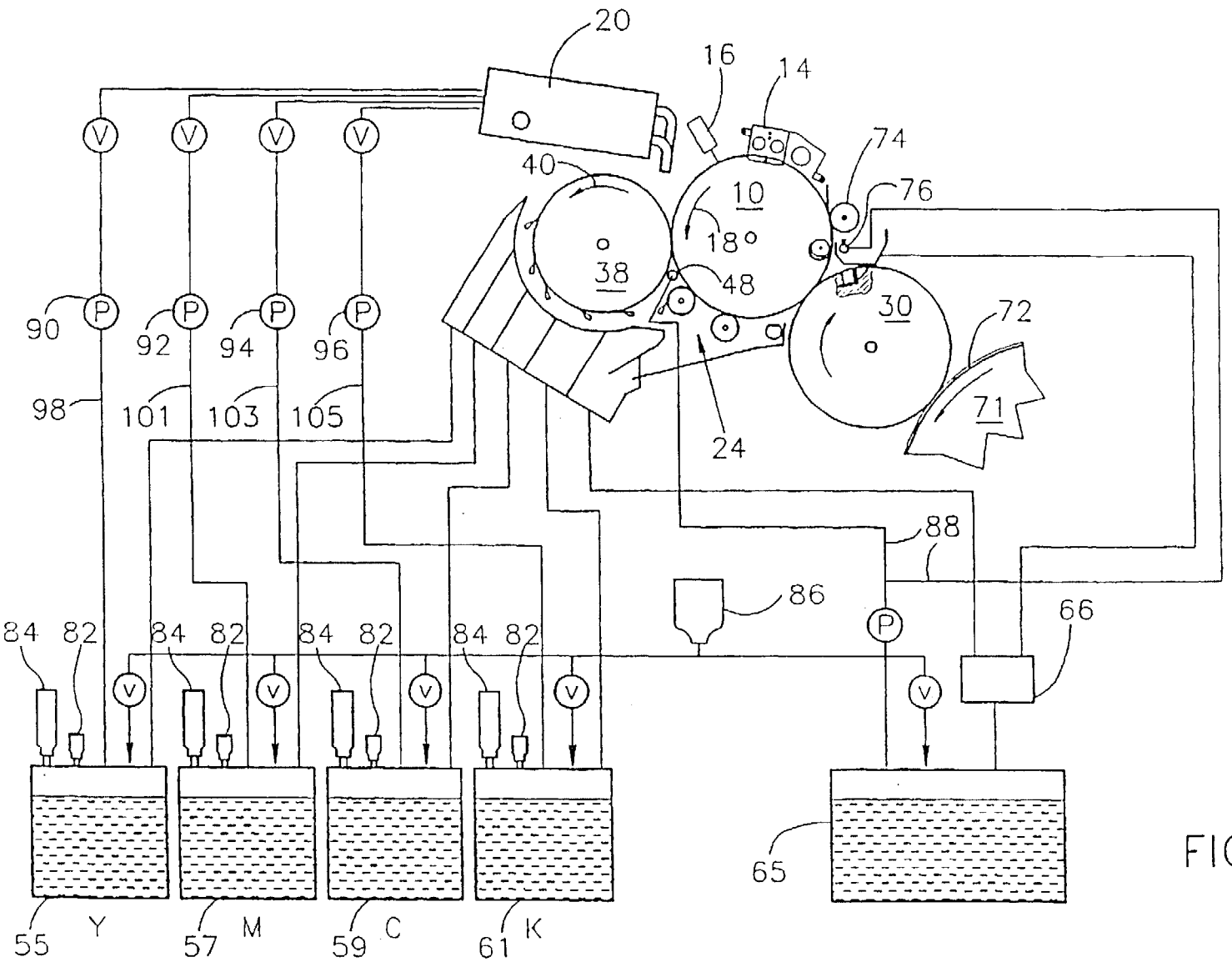
FIG. 1 is a simplified sectional illustration of electrostatic imaging apparatus constructed and operative in accordance with a preferred embodiment of the present invention.
Figure 2:
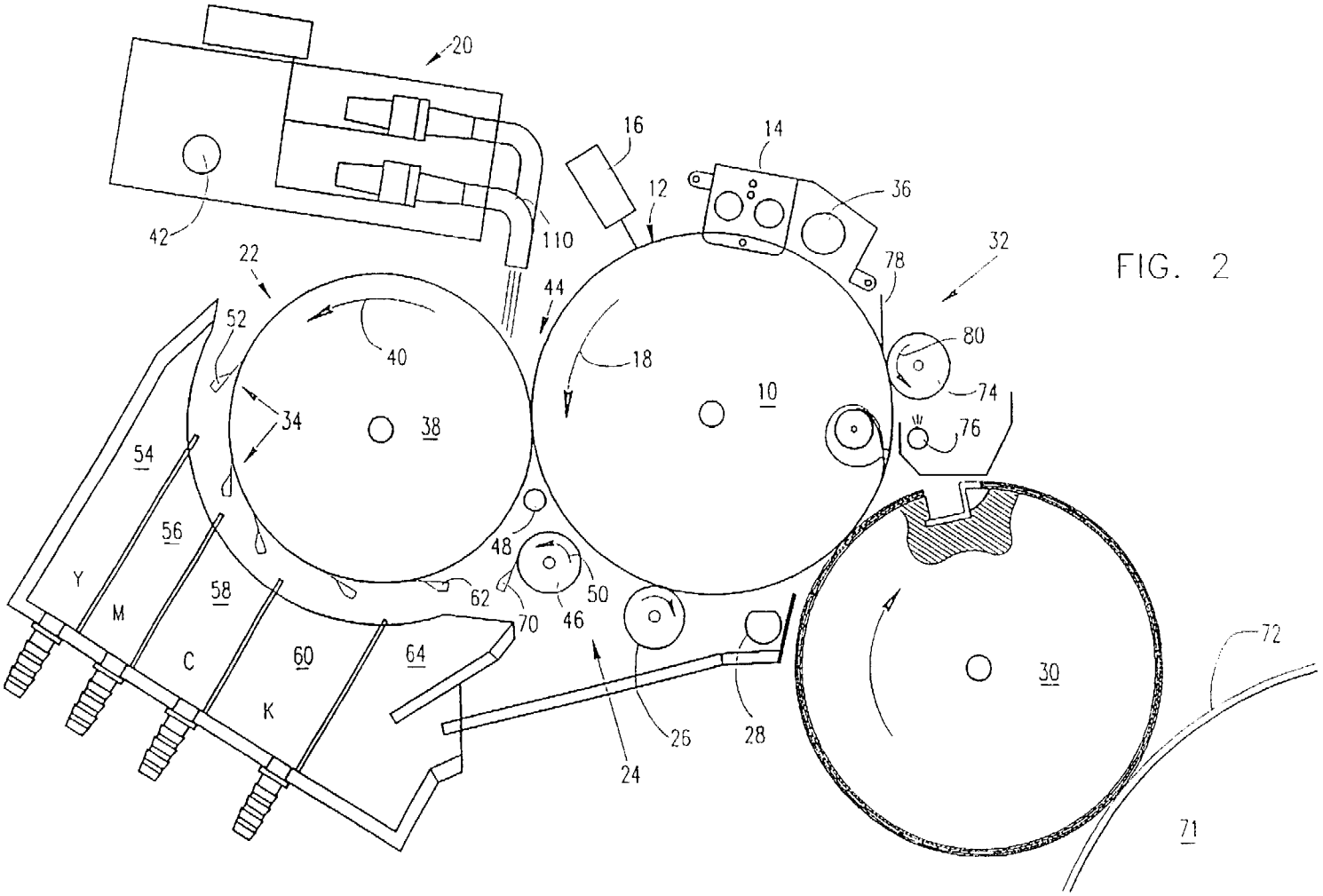
FIG. 2 is a simplified enlarged sectional illustration of the apparatus of FIG. 1.

Reference is now made to FIGS. 1 and 2 which illustrate a multicolor electrostatic imaging system constructed and operative in accordance with a preferred embodiment of the present invention. As seen in FIGS. 1 and 2 there is provided an imaging sheet, preferably an organic photoreceptor 12, typically mounted on a rotating drum 10. Drum 10 is rotated about its axis by a motor or the like (not shown), in the direction of arrow 18, past charging apparatus 14, preferably a corotron, scorotron or roller charger or other suitable charging apparatus known in the art and which is adapted to charge the surface of sheet photoreceptor 12. The image to be reproduced is focused by an imager 16 upon the charged surface 12 at least partially discharging the photoconductor in the areas struck by light, thereby forming the electrostatic latent image. Thus, the latent image normally includes image areas at a first electrical potential and background areas at another electrical potential.

Photoreceptor sheet 12 may use any suitable arrangement of layers of materials as is known in the art, however, in the preferred embodiment of the photoreceptor sheet, certain of the layers are removed from the ends of the sheet to facilitate its mounting on drum 10.

This preferred photoreceptor sheet and preferred methods of mounting it on drum 10 are described in a co-pending U.S. Patent application of Belinkov et al., IMAGING APPARATUS AND PHOTORECEPTOR THEREFOR, filed Sep. 7, 1994, assigned Ser. No. 08/301,775, the disclosure of which is incorporated herein by reference. Alternatively, photoreceptor 12 may be deposited on the drum 10 and may form a continuous surface. Furthermore, photoreceptor 12 may be a non-organic type photoconductor based, for example, on a compound of Selenium.

Imaging apparatus 16 may be a modulated laser beam scanning apparatus, an optical focusing device for imaging a copy on a drum or other imaging apparatus such as is known in the art.

Also associated with drum 10 and photoreceptor sheet 12, in the preferred embodiment of the invention, are a multicolor liquid developer spray assembly 20, a developing assembly 22, color specific cleaning blade assemblies 34, a background cleaning station 24, an electrified squeegee 26, a background discharge device 28, an intermediate transfer member 30, cleaning apparatus 32, and, optionally, a neutralizing lamp assembly 36.

Developing assembly 22 preferably includes a development roller 38. Development roller 38 is preferably spaced from photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

Multicolor liquid developer spray assembly 20, whose operation and structure is described in detail in U.S. Pat. No. 5,117,263, the disclosure of which is incorporated herein by reference, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, assembly 20 may be fixed. Preferably, the spray is directed onto a portion of the development roller 38.

Color specific cleaning blade assemblies 34 are operatively associated with developer roller 38 for separate removal of residual amounts of each colored toner remaining thereon after development. Each of blade assemblies 34 is selectably brought into operative association with developer roller 38 only when toner of a color corresponding thereto is supplied to development region 44 by spray assembly 20. The construction and operation of cleaning blade assemblies is described in PCT Publication WO 90/14619 and in U.S. Pat. No. 5,289,238, the disclosures of which are incorporated herein by reference.

Each cleaning blade assembly 34 includes a toner directing member 52 which serves to direct the toner removed by the cleaning blade assemblies 34 from the developer roller 38 to separate collection containers 54, 56, 58, and 60, for each color to prevent contamination of the various developers by mixing of the colors. The toner collected by the collection containers is recycled to a corresponding toner reservoir (55, 57, 59 and 61). A final toner directing member 62 always engages the developer roller 38 and the toner collected thereat is supplied into collection container 64 and thereafter to reservoir 65 via separator 66 which is operative to separate relatively clean carrier liquid from the various colored toner particles. The separator 66 may be typically of the type described in U.S. Pat. No. 4,985,732, the disclosure of which is incorporated herein by reference.

In a preferred embodiment of the invention, as described in U.S. Pat. No. 5,255,058, the disclosure of which is incorporated herein by reference, where the imaging speed is very high, a background cleaning station 24 typically including a reverse roller 46 and a fluid spray apparatus 48 is provided. Reverse roller 46 which rotates in a direction indicated by arrow 50 is electrically biased to a potential intermediate that of the image and background areas of photoconductive drum 10, but different from that of the development roller. Reverse roller 46 is preferably spaced apart from photoreceptor sheet 12 thereby forming a gap therebetween which is typically 40 to 150 micrometers.

Fluid spray apparatus 48 receives liquid toner from reservoir 65 via conduit 88 and operates to provide a supply of preferably non-pigmented carrier liquid to the gap between sheet 12 and reverse roller 46. The liquid supplied by fluid spray apparatus 48 replaces the liquid removed from drum 10 by development assembly 22 thus allowing the reverse roller 46 to remove charged pigmented toner particles by electrophoresis from the background areas of the latent image. Excess fluid is removed from reverse roller 46 by a liquid directing member 70 which continuously engages reverse roller 46 to collect excess liquid containing toner particles of various colors which is in turn supplied to reservoir 65 via a collection container 64 and separator 66.

The apparatus embodied in reference numerals 46, 48, 50 and 70 is not required for low speed systems, but is preferably included in high speed systems.

Preferably, an electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles.

In a first preferred embodiment the squeegee roller is made by molding a soft polyurethane rubber coating onto a metal core, coating the molded core with a conductive lacquer and coating the lacquer with a low conductivity elastomer. Alternatively, in a second embodiment, the molded coating can be made of an elastomer with a controlled conductivity and the lacquer can be omitted. In a third embodiment, a single coating of controlled conductivity elastomer is used and the outer layer is omitted.

In the first squeegee embodiment the metal core is cleaned, and coated with a rubber to metal adhesive, such as, for example CILBOND 49 SF (Compounding Ingredients Limited, UK) dissolved in an equal amount of methyl ethyl ketone, which is dried at 110° C. for one hour. An outer mold having a diameter about 9.5 mm greater than that of the core is dip coated with a release agent, such as, for example, a mixture of 10 parts Syl-Off 7600 (Dow Corning), 1 part Syl-Off 7601 and 150 parts n-hexane which is then cured for one hour at 110° C. The space between the core and the mold (pre-heated to 70°–80° C.) is filled with polyurethane rubber for casting (CIL A 20, Compounding Ingredients Limited, UK) which is preheated under vacuum at 80° C. for 16 hours and then at 120° C. for an additional hour. The polyurethane is cured at 135° C. for 8 hours. After cooling and removal of the coated core from the mold (which removal may be aided by a solvent, such as Isopar), the cast material is ground to size to approximately ±5 micrometers. The preferred hardness of the coating is about 20 Shore A, although this hardness may vary from 15–40 Shore A depending on the amount of liquid removal desired.

The ground surface is cleaned with acetone and preferably dip coated with a conductive lacquer (preferably, 3 parts H322 (Lord Corporation, USA) and 1 part ethyl acetate) which has been prefiltered through a lint free cloth to give a thickness (after drying) of about 30 micrometers.

A top layer of 50 parts Fomrez 50 (Witco. Corp., USA) dissolved in 75 parts ethyl acetate to which is added 3 parts of DC193 (Dow Corning) and about 6 parts of di-phenyl methane 4,4' di-isocyanate (MDI) (Desmodor 44V20 manufactured by Bayer, Germany) is filtered and dip coated onto the lacquer coating a plurality of times to achieve a coating thickness of 60–70 micrometers. The coated squeegee is dried at room temperature and cured at 140° C. for 2 hours. The preferred hardness of the material forming the outer layer is about 30–35 Shore A and this hardness can be controlled by changing the proportion of MDI in the coating. The coating has a resistivity in the range of $10^8$ to $10^{10}$ ohm-cm, with a preferred value of $1–3\times10^8$ to $2–3\times10^9$ ohm-cm.

In the second embodiment of the squeegee roller, the cast covering for the core is preferably an elastomer having the proper combination of hardness (15–30 Shore A, preferably 20 Shore A) and resistivity ($1–10\times10^6$ ohm-cm). This material can be polyurethane, nitrile or other oil resistant rubber. Polyurethane with selectable resistivity and hardness is available from Merthane Products (USA). After casting as described above, the coating is ground to size and finish and coated with a top layer which is made in the same manner as the top layer of the first embodiment.

In the third embodiment of the squeegee roller, the top layer is omitted and the conductive elastomer is preferably cast to exact size.

Discharge device 28 is operative to flood the sheet 12 with light which discharges the voltage remaining on sheet 12, mainly to reduce electrical breakdown and improve transfer of the image to intermediate transfer member 30. Operation of such a device in a write black system is described in U.S. Pat. No. 5,280,326, the disclosure of which is incorporated herein by reference.

FIGS. 1 and 2 further show that multicolor toner spray assembly 20 receives separate supplies of colored toner typically from four different reservoirs 55, 57, 59 and 61. FIG. 1 shows four different colored toner reservoirs 55, 57, 59 and 61 typically containing the colors Yellow, Magenta, Cyan and, optionally, Black respectively. Pumps 90, 92, 94 and 96 may be provided along respective supply conduits 98, 101, 103 and 105 for providing a desired amount of pressure to feed the colored toner to multicolor spray assembly 20. Alternatively, multicolor toner spray assembly 20, which is preferably a three level spray assembly, receives supplies of colored toner from up to six different reservoirs (not shown) which allows for custom colored toner in addition to the standard process colors.

A preferred type of toner for use with the present invention is that described in Example 1 of U.S. Pat. No. 4,794,651, the disclosure of which is incorporated herein by reference or variants thereof as are well known in the art. For colored liquid developers, carbon black is replaced by color pigments as is well known in the art. Other toners may alternatively be employed, including liquid toners and, as indicated above, including powder toners.

Another preferred embodiment of the toner for use in the invention is prepared using the following method:

1) Solubilizing 1400 grams of Nucrel 925 (ethylene copolymer by Dupont) and 1400 g of Isopar L (Exxon) are thoroughly mixed in an oil heated Ross Double Planetary Mixer at least 24 RPM for 1.5 hours, with the oil temperature at 130° C. 1200 g of preheated Isopar L is added and mixing is continued for an additional hour. The mixture is cooled to 45° C., while stirring is continued over a period of several hours, to form a viscous material.
2) Milling and Grinding 762 grams of the result of the Solubilizing step are ground in a 1S attritor (Union Process Inc. Akron, Ohio), charged with 3/16" carbon steel balls at 250 RPM, together with 66.7 grams of Mogul L carbon black (Cabot), 6.7 grams of BT 583D (blue pigment produced by Cookson), 5 grams of aluminum tri stearate and an additional 1459.6 grams of Isopar L for eight hours at 30° C.
3) Continuation of Grinding 34.5 grams of ACumist A-12 (a micronised polyethylene wax produced by Allied Signal) is added and grinding is continued for an additional 4 hours. The resulting particles are fibrous particles have a measured diameter in the range of 1–3 micrometers.

The resulting material is diluted with additional Isopar L and Marcol 82 to give a working developer in which the dry solids portion is about 1.7% and in which the overall ratio of Isopar L to Marcol is between about 50:1 and 500:1, more preferably between about 100:1 and 200:1. Charge director as described in U.S. patent application Ser. No. 07/915,291 (utilizing lecithin, BBP and ICIG3300B) and in WO 94/02887, in an amount equal to 40 mg/gm of solids, is added to charge the toner particles. Other charge directors and additional additives as are known in the art may also be used.

The above described process produces a black toner. Cyan, magenta and yellow toners can be produced by using a different mix of materials for step 2). For Cyan toner, 822 g of the solubilized material, 21.33 grams each of BT 583D and BT 788D pigments (Cookson), 1.73 grams of D1355DD pigment (BASF), 7.59 grams of aluminum tri stearate and 1426 grams of Isopar L are used in step 2. For Magenta toner, 810 grams of solubilized material, 48.3 grams of Finess Red F2B, 6.81 grams of aluminum tri-stearate and 1434.2 grams of Isopar L are used in step 2. For yellow toner 810 grams of solubilized material, 49.1 grams of D1355DD pigment, 6.9 grams of aluminum tri-stearate and 1423 grams of Isopar L are used in step 2.

Intermediate transfer member 30, an especially preferred embodiment of which is described in detail below (in conjunction with FIGS. 3 and 4), may, for some embodiments of the invention, be any suitable intermediate transfer member having a multilayered transfer portion such as those described below or in U.S. Pat. Nos. 5,089,856 or 5,047,808 or in the applications of which this application is a continuation in part, the disclosures of which are incorporated herein by reference and by other structures known in the art. Member 30 is maintained at a suitable voltage and temperature for electrostatic transfer of the image thereto from the image bearing surface. Intermediate transfer member 30 is preferably associated with a pressure roller 71 for transfer of the image onto a final substrate 72, such as paper, preferably by heat and pressure. For the especially preferred toner described above, an image temperature of about 95° C. at the inception of fusing is preferred.

Certain aspects of the present invention, especially the method of mounting a transfer blanket on a drum are of general applicability and are applicable to a wide range of blanket types for ink, liquid toner or powder toner as are known in the art.

Cleaning apparatus 32 is operative to scrub clean the surface of photoreceptor 12 and preferably includes a cleaning roller 74, a sprayer 76 to spray a non-polar cleaning liquid to assist in the scrubbing process and a wiper blade 78 to complete the cleaning of the photoconductive surface. Cleaning roller 74 which may be formed of any synthetic resin known in the art for this purpose is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given color, the single color image is transferred to intermediate transfer member 30. Subsequent images in different colors are sequentially transferred in alignment with the previous image onto intermediate transfer member 30. When all of the desired images have been transferred thereto, the complete multi-color image is transferred from transfer member 30 to substrate 72. Impression roller 71 only produces operative engagement between intermediate transfer member 30 and substrate 72 when transfer of the composite image to substrate 72 takes place. Alternatively, each single color image is separately transferred to the substrate via the intermediate transfer member. In this case, the substrate is fed through the machine once for each color or is held on a platen and contacted with intermediate transfer member 30 for composite image transfer. Alternatively, the intermediate transfer member is omitted and the developed single color images are transferred sequentially directly from drum 10 to substrate 72.

Figure 3A:
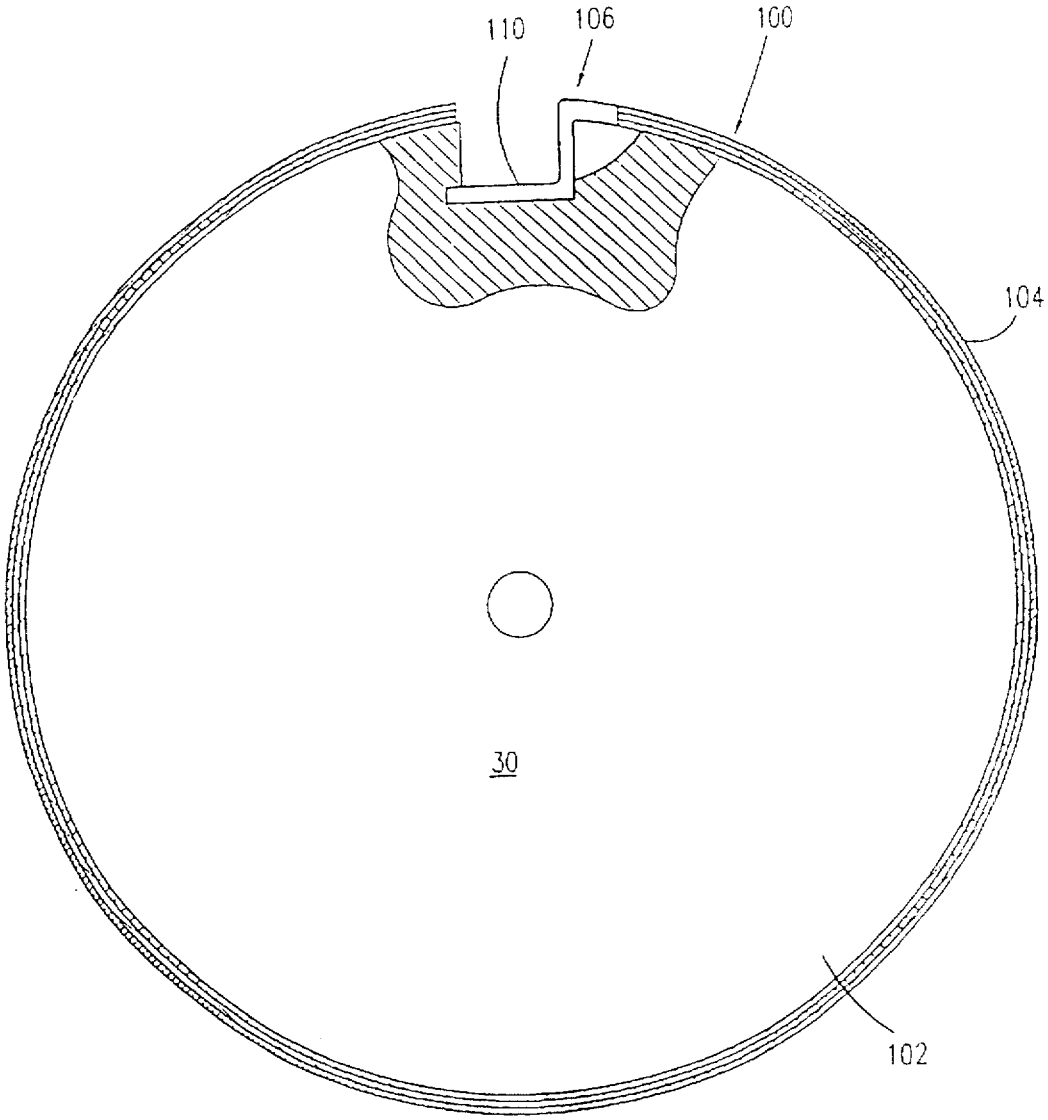
FIG. 3A is a simplified, cross-sectional side view of an intermediate transfer member, including a removable intermediate transfer blanket mounted on a drum, in accordance with a preferred embodiment of the invention.
Figure 3B:
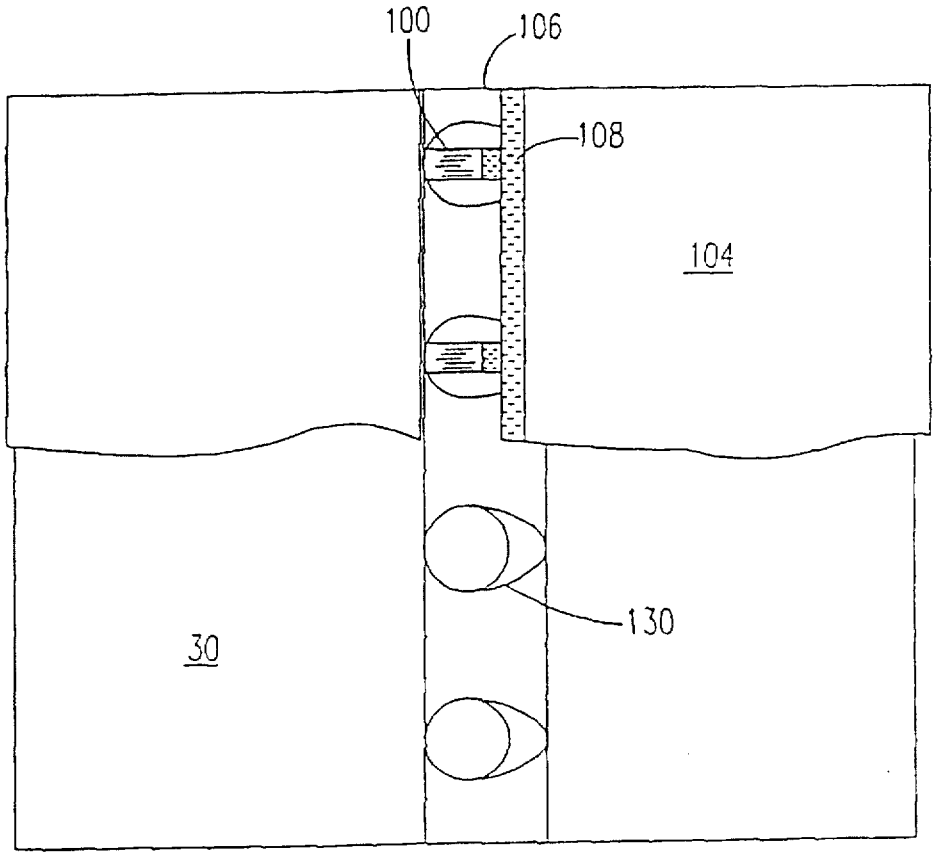
FIG. 3B is a partially cut-away top view of the intermediate transfer member of FIG. 3A.
Figure 4A:
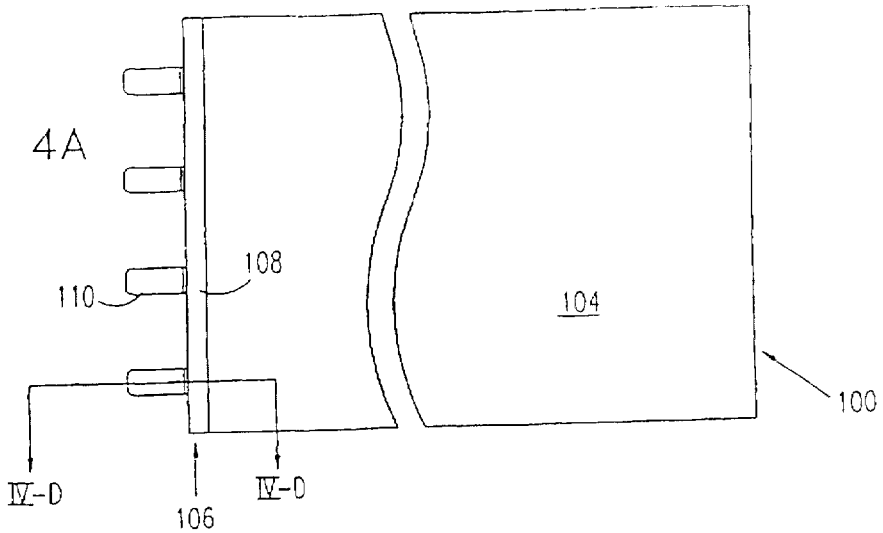
FIGS. 4A and 4B are respective top and side views of an intermediate transfer blanket in accordance with a preferred embodiment of the invention.
Figure 4B:
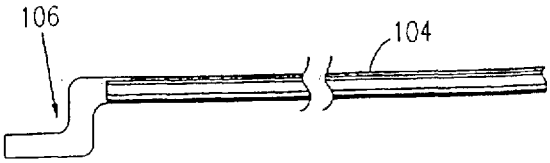
Figure 4C:
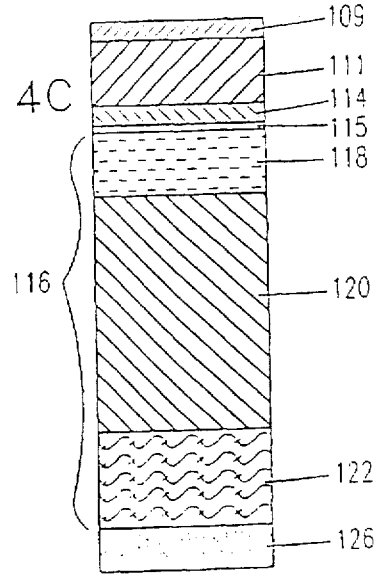
FIG. 4C shows details of the layered construction of the intermediate transfer blanket in accordance with a preferred embodiment of the invention.
Figure 4D:
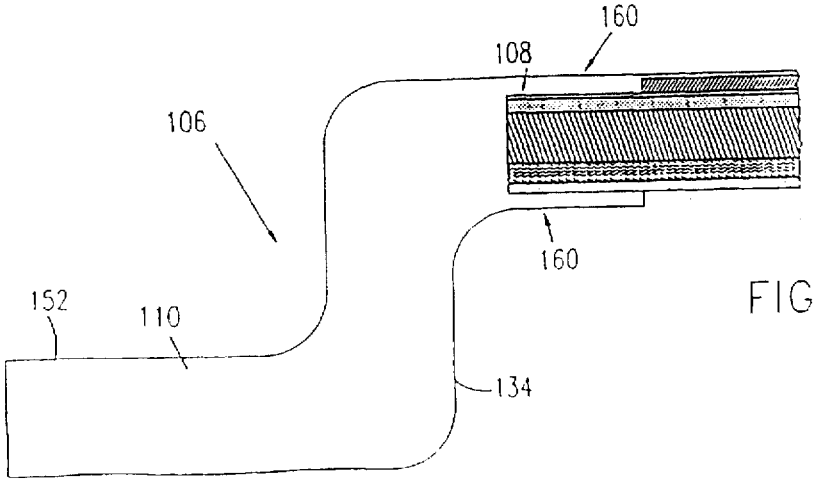
FIG. 4D is a cut-away expanded view of a securing mechanism on the intermediate transfer blanket of FIGS. 4A and 4B.

FIGS. 3A, 3B and 4A–4D illustrate a preferred embodiment of intermediate transfer member 30 in accordance with a preferred embodiment of the invention. FIG. 3A shows an intermediate transfer blanket 100 mounted on a drum 102. Transfer blanket 100 (whose details are shown in FIGS. 4C and 4D) comprises a preferably layered transfer portion 104 and a mounting fitting 106.

As shown most clearly in FIG. 4C, transfer portion 104 comprises a release layer 109 which is outermost on the blanket when it is mounted on drum 102. Underlying layer 109 is a conforming layer 111 preferably of a soft elastomer, preferably of polyurethane and preferably having a Shore A hardness of less than about 65, more preferably, less than about 55, but preferably more than about 35. A suitable hardness value is between 45–55, preferably about 50. Underlying layer 111 is a conductive layer 114 which overlays a thin barrier layer 115. Barrier layer 115 overlays a blanket body 116 comprising a top layer 118, a compressible layer 120 and a fabric layer 122. Underlying the fabric layer is preferably an adhesive layer 126 which is in contact with drum 102.

Drum 102 is preferably heated by an internal halogen lamp heater or other heater to aid transfer of the image to and from the release layer 109 to a final substrate as is well known in the art. Other heating methods, or no heating at all, may also be used in the practice of some aspects of the invention. The degree of heating will depend on the characteristics of the toner and or ink used in conjunction with the invention.

As shown in FIGS. 4A, 4B and 4D, mounting fitting 106 comprises an elongate electrically conducting bar 108, for example of a metal such as aluminum formed with a series of L-shaped mounting legs 110 (in the form of finger-like extensions) which are also conducting, preferably of the same material as bar 108, and preferably formed integrally therewith. In particular, bar 108 is formed with a slot into which the end of layered transfer portion 104 is inserted. Preferably, the end of the layered portion which is inserted into the mounting bar does not have a release layer 109 or conforming layer 111, whereby conducting layer 114 is exposed and is therefore in electrical contact with bar 108. Alternatively, the bar 108 can be formed with sharp internal projections which pierce the outer layers of the blanket and contact the conducting layer.

Optionally, each of the layers beneath the conducting layer 114 may be partially conducting (for example, by the addition of conductive carbon black or metal fibers) and the adhesive layer may be conductive, such that current also flows directly from the drum surface to the conducting layer.

In one preferred embodiment of the invention, fitting 106 is formed of a single sheet of metal, wherein the legs are partially cut from the metal which is bent into a U shape to form the slot into which the layered portion is inserted. After insertion, the outer walls of the slot are forced against the layered portion to secure the layered portion in the slot. The partially cut out portion is bent to form the mounting legs.

In the preferred embodiment of the invention shown in FIGS. 1–3, drum 102 is maintained at a potential suitable for transferring images to the intermediate transfer member, for example at 500 volts, which voltage is applied, via mounting fitting 106 to conductive layer 114. Thus, the source of transfer voltage is very near the outer surface of portion 104 which allows for a lower transfer potential on the drum.

In a preferred embodiment of the invention, Transfer portion 104 is fabricated by the following procedure:

1— The starting structure for blanket construction is a blanket body 116 generally similar to that generally used for printing blankets. One suitable body is MCC-1129-02 manufactured and sold by Reeves SpA, Lodi Vecchio (Milano), Italy. Other preferred blanket types are described in the parents of this application, which are incorporated herein by reference. In a preferred embodiment of the invention, body 116 comprises a fabric layer 122, preferably of woven NOMEX material and having a thickness of about 200 micrometers, a compressible layer 120, preferably comprising about 400 micrometers of saturated nitrile rubber loaded with carbon black to increase its thermal conductivity. Layer 120 preferably contains small voids (about 40–60% by volume) and a top layer 118 preferably comprised of the same material as the compressible layer, but without voids. Layer 109 is preferably about 100 micrometers thick. The blanket body is produced by manufacturing methods as are generally used for the production of offset printing blankets for ink offset printing.

Blanket body 116 is preferably sized to a relatively exact thickness by abrading portions of the surface of top layer 118. A preferred thickness for the finished body 116 is about 700 micrometers, although other thicknesses are useful, depending on the geometry of the printing system in which it is used and the exact materials used in the blanket body.

2— The fabric side of blanket body 116 is preferably coated with a 30 micrometer thick coating of silicone based adhesive (preferably, Type D 66 manufactured by Dow Corning). The adhesive is covered with a sheet of mylar coated with a fluorosilicone material, such as DP 5648 Release Paper (one side coat) distributed by H.P. Smith Inc., Bedford Park, Ill. This adhesive is characterized by its good bond to the surface of drum 102 and is resistant to the carrier liquid used in the liquid toner. The blanket may be removed from the drum, when its replacement is desired, by cutting the blanket along the edge of fitting 106 and removing the blanket and fitting.

An adhesive is used to assure good thermal contact between the back of the blanket and the drum on which it is mounted. A silicone adhesive is used since adhesives normally used in attachment of blankets deteriorate under the heat which is generated in the underlying drum in the preferred apparatus. While the temperature of the drum varies, depending on the thermal resistance of the blanket and the desired surface temperature of the blanket (which in turn depends on the toner used in the process and the details of transfer of the toner to the final substrate), the drum temperature may reach 80° C., 100° C., 120° C. or 150° C. or more.

3— Top layer 118 is preferably coated with a sub-micron layer of primer before being coated with additional layers. A preferred primer is Dow Corning 1205 Prime Coat. The type of primer depends on the properties of the top layer and of the conductive layer. Preferably, 0.3 micron of primer is coated onto a clean top layer with a No. 0 bar in a wire-rod coating apparatus and is allowed to dry before applying the conductive layer.

4— Since blanket body 116 may contain materials such as anti-oxidants, anti-ozonants or other additives which may migrate through the upper layers of the blanket, for example as a gas when the blanket is heated during the imaging process and/or in the presence of carrier liquid such as Isopar L, barrier layer 115 is preferably coated onto top layer 118 (or more exactly onto the primer). This barrier layer should be substantially impervious to such materials in the blanket body which may migrate and/or to the carrier liquid which is used.

If this layer is omitted, under certain circumstances the additive materials can cause deterioration of the photoreceptor. In particular, it was found that the imaging process may become humidity dependent.

In a preferred embodiment of the invention, a 4–11 micrometer layer of polyvinyl alcohol (88% hydrolyzed) is coated onto the primer layer covering top layer 118.

Polyvinyl alcohol, 88% hydrolyzed, having an average molecular weight preferably between 85,000 and 145,000 (Aldrich Chemical Co. Inc., Milwaukee, Wis.) is dissolved in water at 90° C. by continuously stirring the mixture in a reflux system for 30 minutes. After 30 minutes, a quantity of ethanol equal to twice the quantity of water is added to the solution, the resulting polyvinyl alcohol concentration being preferably less than 10%. Higher concentration solutions can be used; however, they give a more viscous solution which is hard to spread evenly.

The solution is deposited on layer 118 of body 116 using a fine wire rod or knife inclined at 30°–45° to the direction of movement of the knife or body. The solvent is evaporated either by drying at room temperature or by blowing hot air on the layer.

One or more coating passes are employed to give the required thickness.

Too thin a layer will result in some transfer of material from body 116, which has been correlated with reduced transfer efficiency from the photoreceptor to the intermediate transfer blanket, which is believed to be caused by photoreceptor deterioration. While four micrometers of material appears to be sufficient to avoid leaching, a somewhat larger thickness is preferably used.

Other barrier materials and other thicknesses may be used depending on the carrier liquid used for the toner or the gasses omitted by body 116. Other barrier materials may require lesser or greater thickness depending on their resistance to the carrier liquid or the gasses released by body 116. Alternatively, if body 116 resists leaching by the carrier liquid or does not contain materials which are released (especially when body 116 is heated) or any anti-oxidants and/or anti-ozonants, layer 115 may be omitted.

Polyvinyl alcohol is a thermoplastic crystalline material having a melting point which is higher than the temperature of the blanket during operation. Polyvinyl alcohol is also believed to form a layer which is impervious to gasses and to the hydrocarbon carrier liquid used in the liquid toner.

5— Conductive layer 114 is preferably formed of acrylic rubber loaded with conductive carbon black. In a preferred embodiment of the invention, only 2–3 micrometers of conductive coating are required. The conductive layer is formed by first compounding 300 grams of Hytemp 4051EP (Zeon Chemicals) with 6 grams of Hytemp NPC 50 and 9 grams of sodium stearate in a two-roll mill for 20 minutes; and then dissolving 150 grams of the compounded material in 2000 grams of methyl ethyl ketone (MEK) by stirring for 12 hours at room temperature.

40 grams of conductive carbon black, such as, for example, Printex XE2 (Degussa) are added to the solution and the mixture is ground in a 01 attritor (Union Process) loaded with 3/16" steel balls. Grinding proceeds at 10° C. for 4 hours after which time the material is diluted by the addition of MEK to a concentration of 7.5–8% solids and discharged from the grinder in the form of a conductive lacquer.

The blanket (after step 3 or step 4) is overcoated with about 3 micrometers of the conductive lacquer (three passes using a No. 0 rod) and allowed to dry for 5 minutes at room temperature.

An additional coating of primer is added over the conductive lacquer (except for the portion which is to be inserted into bar 108) before the soft elastomeric conforming layer is applied.

The resistance of the conductive layer should preferably be more than about 20 kohms/square and preferably less than about 50 kohm/square. This value will depend on the resistivity of the layers above the conducting layer and on the aspect ratio of the blanket. In general, the resistance should be low enough so that the current flowing on the conducting layer (to supply leakage current through the overlying layers) should not cause a substantial variation of voltage along the surface of the blanket. The resistance of the conducting layer and, more importantly, the resistance of the overlying layers control the current flowing through the overlying layers. Generally speaking, the conductive layer has a relatively low resistance and resistivity, the conforming layer (layer 111) has a higher resistivity and the overlying release layer (layer 109) has a still higher resistivity.

6— One kg of pre-filtered Fomrez-50 polyester resin (Hagalil Company, Ashdod, Israel) is dehydrated and degassed under vacuum at 60° C. 600 grams of the degassed material is mixed with 1.4 grams of di-butyl-tin-diluarate (Aldrich) and degassed at room temperature for 2 hours. 30 grams of the resulting material, 3.15 grams of RTV Silicone 118 (General Electric) and 4.5 grams of Polyurethane cross-linker, DESMODUR 44V20 (Bayer) are stirred together. A 100 micrometer layer of the material is coated over the primed conductive layer using a No. 3 wire rod with several passes under clean conditions, preferably, class 100 conditions. The coating is cured for two hours at room temperature under a clean hood to form a polyurethane layer.

Other methods of forming suitable conforming layers are shown and described in the parents of this application. Alternatively, the conductive layer may be omitted and layer 118 made conductive.

Layer 111 which is thus formed should have a resistance of the order of about $10^9$ ohm-cm, good thermal stability at the working temperature of the blanket surface, which is preferably about 100° C. or less.

The function of the conforming layer is to provide good conformation of the blanket to the image forming surface (and the image on the image forming surface) at the low pressures used in transfer of the image from the image forming surface to the blanket. The layer should have a Shore A hardness preferably of between 25 or 30 and 65, more preferably about 50. While a thickness of 100 micrometers is preferred, other thicknesses, between 50 micrometers and 300 micrometers can be used, with 75 to 125 micrometers being preferred.

7— 12 grams of RTV silicone 236 (Dow Corning) release material preferably diluted with 2 grams of Isopar L (Exxon) and 0.72 grams of Syl-off 297 (Dow Corning) are mixed together. A wire rod (bar No. 1) coating system is used, with five or six passes, under clean conditions to achieve an 8 micrometer release layer thickness. The material is cured at 140° C. for two hours. The cured release material has a resistivity of approximately $10^{14}$ to $10^{15}$ ohm-cm.

In order to mount blanket 100 on drum 102, mounting legs 110 are inserted into a plurality of mounting holes 130 formed in drum 102, preferably without removing the mylar sheet from the adhesive layer (the back of the blanket). As can be seen most clearly in FIG. 3A, 3B and 4D, mounting legs 110 each have a tip portion 132 and a back portion 134. Tips 132 are inserted into slots formed in the far sidewalls of mounting holes 130 and the back portion 134 rests against the opposite sidewall of the hole. In this way the end of the blanket is accurately positioned. The edge of the mylar sheet closest to the legs is removed and the remainder of the mylar sheet is progressively removed while making sure that the successive portions of the blanket which are thus attached to the drum by the adhesive lie flat against the drum.

The present inventors have found that this method of mounting is far superior to either adhesive mounting alone or to grippers at both ends of the blanket in providing a stable transfer surface.

As an alternative to, or additional to, the adhesive layer 126, a very soft conforming layer may be used at the back of the blanket. A soft layer of this type will allow for good thermal contact between the blanket and the heated drum 102 so that the temperature of the drum need not be excessive in order for the outer surface of the blanket to reach its operating temperature. Furthermore, such a very soft layer will cause the blanket to "cling" to the drum obviating the use of adhesive under certain circumstances. Furthermore, when the blanket is replaced there is no adhesive residue on the drum to be removed.

A very soft layer may be produced by the following method:

1— 100 g of Hi-Temp 4051 EP (Zeon) acrylic resin is mixed with 2 g NPC-50 crosslinker (Zeon) and 3 g sodium stearate and dissolved in toluene to give a solution of 15% non-volatile solids. Optionally, up to about 40 g of carbon black Pearls 130 (Cabot) is added.

2— A thin layer of the solution is coated onto release coated mylar and dried. This process is repeated several times until a thickness of preferably 20–30 micrometers is achieved.

3— The uncured resin is laminated to the adhesive layer of a blanket produced in accordance with the invention, or directly to the fabric layer. This step is preferably carried out prior to the cure of the release layer.

4— The laminated structure is cured together with the release layer and the release coated mylar is removed.

The layer has a Shore A hardness of about 20–24 without carbon black and about 40–45 with carbon black. Softer materials are also suitable; however, substantially harder materials do not adhere well to the drum surface. Optionally, the adhesive layer at the trailing end of the blanket is not coated with the very soft layer to improve coherence of the blanket and the drum. This is especially desirable for harder layers.

The acrylic material may be replaced by other soft elastomer materials such as soft polyurethane or nitrile rubber. Other heat improving fillers which have a smaller effect on the hardness of the final product may be used instead of carbon black, such as $Fe_2O_3$ or alpha aluminum oxide.

Figure 5:
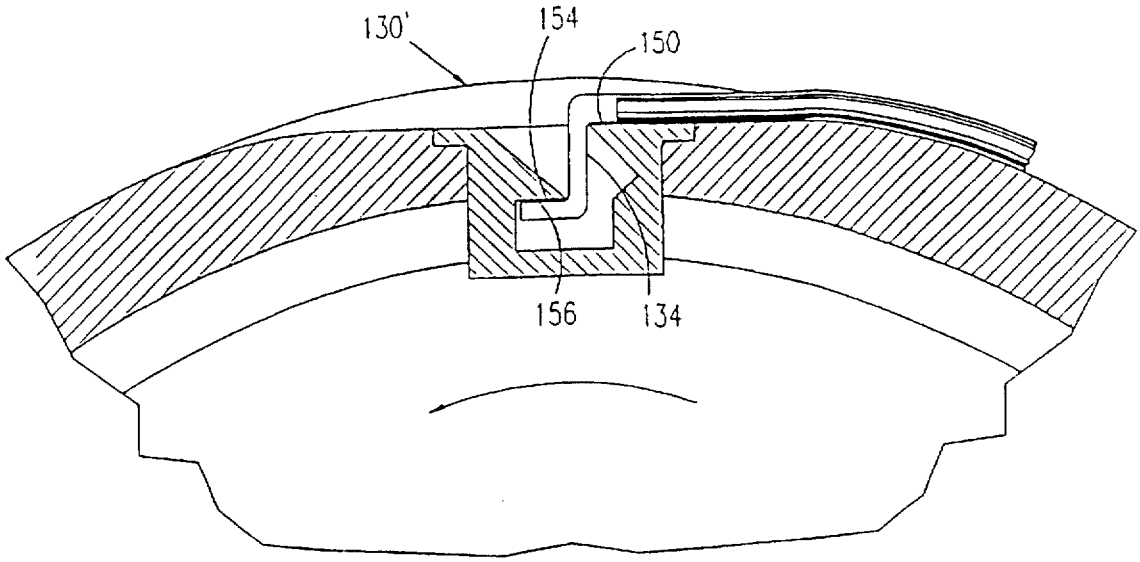
FIG. 5 is a simplified cross-sectional illustration of a portion of an intermediate transfer member, including a removable intermediate transfer blanket mounted on a drum in accordance with another preferred embodiment of the invention.

FIG. 5 shows an alternative, preferred embodiment of the invention in which somewhat different shaped holes 130' are used. In this embodiment the back portion 134 rests against a protrusion 150 formed on one side of the hole while a surface 154 of leg 110 rests against the bottom 156 of a protrusion formed on the other side of the hole.

While the preferred electrical connection between the conductive layer and the mounting bar is preferably achieved by removing (or not forming) the layers which overlay an end portion of the conductive layer, piercing the overlying layers, for example, by crimping and/or piercing the mounting bar, for example, at points marked 160 in FIG. 4D. Crimping can also be used to hold the blanket in the mounting bar.

While the adhesive layer preferably covers the back of the blanket, alternatively the adhesive layer may cover only a portion of the back such as the edge farthest away from the bracket (the trailing edge of the blanket); or may, for some embodiments of the invention and under certain circumstances, be omitted.

It should be understood that some aspects of the invention are not limited to the specific type of image forming system used and some aspects of the present invention are also useful with any suitable imaging system which forms a liquid toner image on an image forming surface and, for some aspects of the invention, with powder toner systems. Some aspects of the invention are also useful in systems such as those using other types of intermediate transfer members such as belt or continuous coated drum type transfer members. Some aspects of the invention are suitable for use with offset printing systems. The specific details given above for the image forming system are included as part of a best mode of carrying out the invention; however, many aspects of the invention are applicable to a wide range of systems as known in the art for electrophotographic and offset printing and copying.

It will be appreciated by persons skilled in the art that the present invention is not limited by the description and example provided hereinabove. Rather, the scope of this invention is defined only by the claims which follow:

We claim:

1. Imaging apparatus comprising:

an imaging surface having a toner image formed thereon; and an intermediate transfer member, which receives the toner image from the imaging surface and from which it is subsequently transferred, comprising:

a drum having mounting recesses formed therein; and an intermediate transfer blanket mounted on the drum, the blanket comprising:

a layered transfer portion having a transfer surface on one face thereof which receives the toner image; and a mounting fixture, attached to only one edge of the layered transfer portion and adapted to mate with the mounting recesses in the drum, whereby the transfer blanket is removably mounted on the drum.

2. Apparatus according to claim 1 wherein at least a portion of a surface of the layered transfer portion opposite to the transfer surface is bonded to the drum.

3. Apparatus according to claim 1 wherein the layered transfer portion comprises an adhesive layer on a second face thereof opposite the transfer surface.

4. Apparatus according to claim 1 wherein the layered transfer portion comprises an electrically conductive layer underlying the transfer surface; and wherein the mounting fixture comprises an electrically conductive element, attached to one edge of the transfer portion, which is electrically connected to the electrically conductive layer.

5. Apparatus according to claim 4 wherein the electrically conductive element contacts the drum and wherein the drum is electrified to a voltage which is operative to transfer the toner image from the imaging surface to the transfer surface.

6. Apparatus according to claim 4 wherein the electrically conductive element comprises at least one "L" shaped finger-like extension extending therefrom.

7. Apparatus according to claim 6 wherein said at least one "L" shaped extension has a first portion extending in a direction perpendicular to the layered transfer portion and a second portion attached and substantially perpendicular to the first portion and extending substantially parallel to and away from the layered transfer portion.

8. Apparatus according to claim 7 wherein said mounting recesses further comprise recesses therein which receive said second portion.

9. A substantially rectangular intermediate transfer blanket comprising:

a layered transfer portion having a transfer surface on one face thereof; and a mounting fixture, adapted for mounting the blanket on a drum, attached to only one edge of the layered transfer portion.

10. An intermediate transfer blanket according to claim 9 wherein the layered transfer portion comprises an electrically conductive layer underlying the transfer surface; and wherein the mounting fixture comprises an electrically conductive element, attached to one edge of the transfer portion, which is electrically connected to the electrically conductive layer.

11. An intermediate transfer blanket according to claim 10 wherein the electrically conductive element comprises at least one "L" shaped finger-like extension extending therefrom.

12. An intermediate transfer blanket according to claim 11 wherein said at least one "L" shaped extension has a first portion extending in a direction perpendicular to the layered transfer portion and a second portion attached and substantially perpendicular to the first portion and extending substantially parallel to and away from the layered transfer portion.

13. An intermediate transfer blanket according to claim 10 wherein the layered transfer portion comprises a conformal layer formed of a material having a Shore A hardness of less than 65.

14. An intermediate transfer blanket according to claim 13 wherein the material has a Shore A hardness of less than about 50.

15. An intermediate transfer blanket according to claim 13 wherein the material has a Shore A hardness of more than about 30.

16. An intermediate transfer blanket according to claim 10 wherein the transfer surface is a release layer for toner.

17. An intermediate transfer blanket according to claim 10 wherein the layered transfer portion comprises an adhesive layer on a side thereof opposite to the transfer surface.

18. An intermediate transfer blanket according to claim 9 wherein the layered transfer portion comprises a conformal layer formed of a material having a Shore A hardness of less than 65.

19. An intermediate transfer blanket according to claim 18 wherein the material has a Shore A hardness of less than about 50.

20. An intermediate transfer blanket according to claim 18 wherein the material has a Shore A hardness of more than about 30.

21. An intermediate transfer blanket according to claim 20 wherein the transfer surface is a release layer for toner.

22. An intermediate transfer blanket according to claim 21 wherein the layered transfer portion comprises an adhesive layer on a side thereof opposite to the transfer surface.

23. An intermediate transfer blanket according to claim 20 wherein the layered transfer portion comprises an adhesive layer on a side thereof opposite to the transfer surface.

24. An intermediate transfer blanket according to claim 18 wherein the transfer surface is a release layer for toner.

25. An intermediate transfer blanket according to claim 18 wherein the layered transfer portion comprises an adhesive layer on a side thereof opposite to the transfer surface.

26. An intermediate transfer blanket according to claim 9 wherein the transfer surface is a release layer for toner.

27. An intermediate transfer blanket according to claim 26 wherein the layered transfer portion comprises an adhesive layer on a side thereof opposite to the transfer surface.

28. An intermediate transfer blanket according to claim 9 wherein the layered transfer portion comprises an adhesive layer on a side thereof opposite to the transfer surface.

29. An intermediate transfer blanket according to claim 9 wherein the layered transfer portion comprises a soft layer, having a Shore A hardness of less than 90, on the surface of the layered transfer portion opposite to the transfer surface.

30. An intermediate transfer blanket according to claim 29 wherein the soft layer has a Shore A hardness of less than about 45.

31. An intermediate transfer blanket according to claim 29 wherein the soft layer has a Shore A hardness of less than about 25.

32. A substantially rectangular intermediate transfer blanket comprising:

a layered transfer portion having a transfer surface on one face and including a conductive layer underlying the transfer surface; and a conductive element, attached to one edge of the transfer portion, which is electrically connected to the conductive layer other than via conduction of the transfer surface.

33. A substantially rectangular intermediate transfer blanket comprising:

a layered transfer portion having a transfer surface on one face and including a conductive layer underlying the transfer surface; and a conductive element, attached to one edge of the transfer portion, which is electrically connected to the conductive layer wherein the conductive element comprises at least one "L" shaped finger-like extension extending therefrom.

34. An intermediate transfer blanket according to claim 33 wherein said at least one "L" shaped extension has a first portion extending in a direction perpendicular to the layered transfer portion and a second portion attached and substantially perpendicular to the first portion extending away from the layered transfer portion.

35. A layered intermediate transfer member comprising:

an outermost transfer surface;

a conforming layer operatively associated with the transfer surface and having a shore A hardness of less than about 65; and a resilient layer, having a resilient deformation to a compressive force, underlying the conforming layer.

36. A layered intermediate transfer member according to claim 35 wherein said conforming layer has a Shore A hardness of less than about 50.

37. A layered intermediate transfer member according to claim 35 wherein said conforming layer has a Shore A hardness of more than about 30.

38. A layered intermediate transfer member according to claim 35 wherein said conforming layer has a Shore A hardness of more than about 35.

39. A layered intermediate transfer member according to claim 35 and also including a conductive layer.

40. A substantially rectangular layered intermediate transfer blanket comprising;

an outermost transfer surface;

a conforming layer operatively associated with the transfer surface and having a shore A hardness of less than about 65; and a resilient layer, having a resilient deformation to a compressive force, underlying the conforming layer.

41. A layered intermediate transfer blanket according to claim 40 wherein said conforming layer has a Shore A hardness of less than about 50.

42. A layered intermediate transfer blanket according to claim 40 wherein said conforming layer has a Shore A hardness of more than about 30.

43. A layered intermediate transfer blanket according to claim 40 wherein said conforming layer has a Shore A hardness of more than about 35.

44. A layered intermediate transfer blanket according to claim 40 and also including a conductive layer.

45. A layered intermediate transfer blanket according to claim 40 wherein the layered transfer portion comprises a soft layer, having a Shore A hardness of less than 90, on a side opposite to the transfer surface.

46. An intermediate transfer blanket according to claim 45 wherein the soft layer has a Shore A hardness of less than about 45.

47. An intermediate transfer blanket according to claim 45 wherein the soft layer has a Shore A hardness of less than about 25.

48. An intermediate transfer member comprising:

a conductive layer having a relatively low electrical resistivity;

an outer layer having a relatively high electrical resistivity; and a third layer intermediate the conductive and outer layers having an electrical resistivity intermediate the relatively low and relatively high electrical resistivities.

49. An intermediate transfer member according to claim 48 wherein the outer layer is a release layer for toner.

50. An intermediate transfer member according to claim 48 wherein the third layer is a conforming layer having a Shore A hardness of less than about 65.

51. A layered intermediate transfer blanket comprising:

a transfer surface on one face of the blanket; and an adhesive layer on the opposite face of the blanket which is stable at a temperature of at least 80° C.

52. An intermediate transfer blanket according to claim 51 wherein the adhesive layer is stable at a temperature above 100° C.

53. An intermediate transfer blanket according to claim 51 wherein the adhesive layer is stable at a temperature above 120° C.

54. An intermediate transfer blanket according to claim 51 wherein the adhesive layer is stable at a temperature above 150° C.

55. A layered intermediate transfer blanket comprising:

a transfer surface on one face of the blanket; and a soft layer on the opposite face of the blanket which has a Shore A hardness of less than 90.

56. An intermediate transfer blanket according to claim 55 wherein the soft layer has a Shore A hardness of less than about 45.

57. An intermediate transfer blanket according to claim 55 wherein the soft layer has a Shore A hardness of less than about 25.

58. An intermediate transfer blanket according to claim 55 wherein the soft layer has a Shore A hardness of about 45.

59. An intermediate transfer blanket according to claim 55 wherein the soft layer comprises an acrylic elastomer.

60. Imaging apparatus comprising:

an imaging surface having an image formed thereon; and an intermediate transfer member, which receives the image from the imaging surface and from which it is subsequently transferred, comprising:

a drum having mounting recesses formed therein; and an intermediate transfer blanket mounted on the drum, the blanket comprising:

a layered transfer portion having a transfer surface on the outer face thereof which receives the image; and a mounting fixture, attached to only one edge of the layered transfer portion and adapted to mate with the mounting recesses in the drum, whereby the transfer blanket is removably mounted on the drum.

61. Imaging apparatus according to claim 60 wherein the layered transfer portion further comprises an adhesive on the face thereof opposite the transfer surface.

62. Imaging apparatus for performing an imaging process, comprising:

an imaging surface having a liquid toner image comprising toner particles and carrier liquid formed thereon; and an intermediate transfer member, which receives the toner image from the imaging surface and from which it is subsequently transferred, comprising:

a layered transfer portion having a transfer surface on one face thereof which receives the toner image;

a resilient layer underlying the transfer surface which comprises a material which is at least partly leachable by the carrier liquid; and a barrier layer that is substantially impervious to the carrier liquid and is situated intermediate the resilient layer and the transfer surface.

63. Imaging apparatus according to claim 62 wherein the barrier layer comprises at least partially hydrolyzed polyvinyl alcohol.

64. A layered intermediate transfer member comprising:

a transfer surface;

a resilient layer underlying the transfer surface which comprises a material which is at least partly leachable by a liquid hydrocarbon; and a barrier layer that is substantially impervious to the liquid hydrocarbon and is situated intermediate the resilient layer and the transfer surface.

65. An intermediate transfer member according to claim 64 wherein the barrier layer comprises at least partially hydrolyzed polyvinyl alcohol.

66. A layered intermediate transfer member for receiving liquid toner images comprising toner particles and carrier liquid comprising:

a transfer surface;

a resilient layer underlying the transfer surface which comprises a material which is at least partly leachable in the carrier liquid; and a barrier layer that is substantially impervious to the carrier liquid and is situated intermediate the resilient layer and the transfer surface.

67. An intermediate transfer member according to claim 66 wherein the barrier layer comprises at least partially hydrolyzed polyvinyl alcohol.

68. Imaging apparatus for performing an imaging process, comprising:

an imaging surface having a liquid toner image comprising toner particles and carrier liquid formed thereon; and an intermediate transfer member, which receives the toner image from the imaging surface and from which it is subsequently transferred, comprising:

a layered transfer portion having a transfer surface on one face thereof which receives the toner image;

a resilient layer underlying the transfer surface which comprises a material which interferes with the operation of the imaging process;

a barrier layer that is substantially impervious to the interfering material comprised in the resilient layer and is situated intermediate the resilient layer and the transfer surface.

69. Imaging apparatus according to claim 68 wherein the barrier layer comprises at least partially hydrolyzed polyvinyl alcohol.

70. Imaging apparatus according to claim 68 wherein the barrier layer is a barrier layer for gasses.

71. A layered intermediate transfer member, comprising:

a transfer surface;

a resilient layer, having a resilient deformation to a compressive force, underlying the transfer surface; and a barrier layer that is substantially impervious to liquid hydrocarbons and is situated intermediate the resilient layer and the transfer surface.

72. A transfer member according to claim 71 wherein the barrier layer comprises at least partially hydrolyzed polyvinyl alcohol.

73. A layered intermediate transfer member, comprising:

a transfer surface;

a resilient layer underlying the transfer surface which releases gases; and a barrier layer that is substantially impervious to the gasses and is situated intermediate the resilient layer and the transfer surface.

74. A transfer member according to claim 73 wherein the barrier layer comprises at least partially hydrolyzed polyvinyl alcohol.

* * * * *